United States Patent [19]

Zahradnik et al.

[11] 3,977,443

[45] Aug. 31, 1976

[54] METHOD OF AND APPARATUS FOR CONTROLLING PUMPS IN LOOMS WITH JET WEFT INSERTION

[75] Inventors: Stanislav Zahradnik, Roztoky u Jilemnice; Hubert Svoboda, Albrechtice nad Orlici; Karel Basek, Bychnov nad Kneznou; Vladislav Ruta, Borohradek; Frantisek Koza, Tyniste nad Orlici, all of Czechoslovakia

[73] Assignee: Elitex, Zavody textilniho strojirenstvi generalni reditalstvi, Liberec, Czechoslovakia

[22] Filed: Aug. 8, 1975

[21] Appl. No.: 603,097

[30] Foreign Application Priority Data

Sept. 4, 1974 Czechoslovakia ..... 6073-74

[52] U.S. Cl. ..... 139/127 P; 226/97

[51] Int. Cl.[2] ..... D03D 47/36

[58] Field of Search ..... 139/127 R, 127 P, 144; 226/7, 97; 239/410, 411, 416.5, 99

[56] References Cited

UNITED STATES PATENTS

| | | | |
|---|---|---|---|
| 2,936,002 | 5/1960 | Opletal | 139/127 P |
| 3,633,808 | 1/1972 | Svaty | 226/97 |
| 3,782,422 | 1/1974 | Vermeulen | 139/127 P |
| 3,885,599 | 5/1975 | Mawdsley et al. | 139/127 P |

*Primary Examiner*—Henry S. Jaudon

[57] ABSTRACT

The pistons of all pumps in a group which supply pressure liquid to respective jet weft inserting nozzles of a loom are left, after sucking the liquid, in a rest dwell by the action of counterpressure of the sucked-in liquid. Thereafter, at the proper time the delivering space of a chosen pump is connected to its respective nozzle. The rest dwell of the piston in said pump is renewed by its following forcing-down in its suction stroke with its delivery space closed.

6 Claims, 1 Drawing Figure

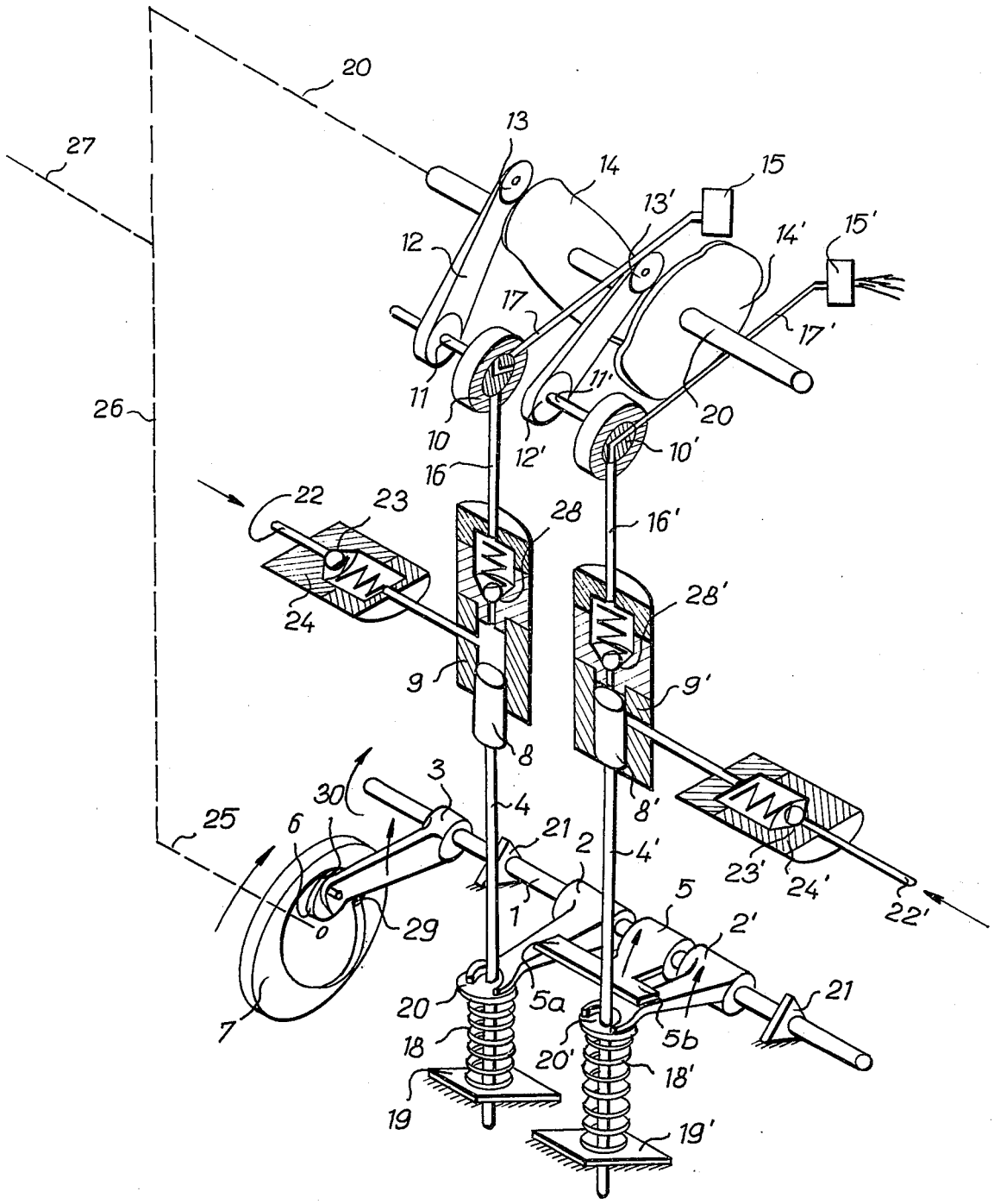
20
27
13
14
15
13'
14'
15'
12
17
17'
11
11'
20
26
10
12'
10'
16
22
23
28
16'
24
28'
9
9'
8
8'
3
30
4
21
2
4'
25
6
23'
24'
22'
5
1
2'
29
20
5a
21
7
18
5b
20'
18'
19
19'

METHOD OF AND APPARATUS FOR CONTROLLING PUMPS IN LOOMS WITH JET WEFT INSERTION

The present invention relates to a method of controlling pumps, particularly groups of piston pumps in looms with hydraulic nozzles for weft insertion alternating according to a preselected program.

In a group of pumps, particularly piston pumps, only a single pump can supply the liquid for the selected nozzle upon each stroke of the loom. The other pumps are either mechanically disengaged, or in their operative position. However, in the latter case the pressure liquid, typically water, escaping therefrom may flow either into a draining vessel or back into the central liquid supply for the pumps, or possibly into a pressure vessel from which the liquid may be transferred, after equalizing the pressure value, into the said central liquid supply. The pressure liquid can be also fed into a vessel from which the liquid returns by gravity to the central liquid supply.

A mechanism for disengaging the pumps from operation mechanically is rather complicated and must be synchronized with a mechanism for selecting pumps.

During constant operation of all pumps in the group, the pressure liquid from all pumps cannot be used, the delivery of pressure liquid back to the central liquid supply representing a considerable wasting of energy. Moreover, a multiple of the necessary liquid quantity must be in circulation; as a result, the pumps are soon worn and a pressure variation is observed in the central liquid supply.

The purpose of the present invention consists in overcoming the above-mentioned disadvantages of the present state of the art. In accordance with the present invention, the pistons of all pumps in a group are left, after sucking the liquid, in a rest dwell by the action of counterpressure of the sucked-in liquid and, after opening the delivering space of the chosen pump, the rest dwell of the piston in said pump being renewed by its following forcing-down into the suction stroke with closed delivery space of the appurtenant pump.

Further advantages and features of the present invention are described in the following specification and are shown in the accompanying drawing, in which:

The single FIGURE illustrates schematically in perspective the arrangement of two piston pumps and a mechanism for their control.

In the illustrative embodiment, two weft inserting nozzles 15, 15' are shown, such nozzles being supplied with weft inserting liquid such as water under pressure in the proper timed relationship with respect to the operation of the loom, by respective pumps 9, 9' which deliver liquid under pressure through valves 10, 10' operated in timed relationship with the loom. The pumps 9, 9' are operated by the following mechanism, shown at the bottom of the single FIGURE of the drawing.

A schematically shown shaft 27 is connected to the main shaft of the loom to be driven thereby. Shaft 27 is connected to a further shaft 26 which is shown extended downwardly to be drivingly connected to a shaft 25 upon which there is secured an internal cam 7. Cam 7, which rotates in the direction of the curved arrow, is provided with a main internal cam portion which is generally in the form of a spiral, the radially inner end of the spiral terminating in a shoulder 29 from which the cam surface drops into a pocket or seat 30 the radially outer end of which merges with the radially outer end of the main spiral portion of the cam track. Upon a rock shaft 1 which is journalled in bearings 21 there is secured a rock lever 3 which on its outer end carries a rotatable cam following roller 6 which cooperates with the above-described cam track of the cam 7. Affixed to the rock shaft 1 and spaced from the lever 3 is a further lever 5 having oppositely extending wings **5*a* and 5*b* on its outer end. Wings 5a and 5b overlie intermediate portions of further levers 2, 2' which are mounted upon and freely rotatable with respect to the shaft 1. The outer ends of the levers 2, 2' are provided with forks disposed in planes parallel to the shaft 1. Through the respective forks on the ends of the levers 2, 2' there extend vertical piston rods 4, 4°. Affixed to the respective piston rods are washers 20, 20' which form upper spring seats for the respective coil compression springs 18, 18' which are telescoped about the lower ends of the piston rods 4, 4' and which have their lower ends in engagement with fixed lower spring seat forming abutments 19, 19'. It will be seen from the above that the washers 20, 20' are constantly urged upwardly and thus constantly urge the levers 2, 2' into engagement with the wings 5*a*, 5*b* of the lever 5. As the cam 7 rotates in the direction of the curved arrow, it periodically thrusts the outer end of the lever 5 downwardly, thereby pulling the piston rods 4, 4' downwardly against the opposition of the springs 18, 18'. When the cam follower 6 drops into the seat 30 of the cam 7 the parts 5, 5*a*, 5*b* and the levers 2, 2' are free to be thrust upwardly by the springs 18, 18', thereby imparting rapid upward movement to the piston rods 4, 4', should the pistons 8, 8' affixed to the respective piston rods 4, 4'** be free for such upward movement.

The pistons 8, 8' form parts of pumps generally designated 9, 9', respectively. Such pumps have vertically extending cylinders therewithin within which the pistons 8, 8' reciprocate. The pump cylinders are supplied with liquid which is sucked thereinto upon the downstroke of the piston through conduits 22, 22' having check valves 24, 24' interposed therein, the check valves having spring pressed balls 23, 23' therein which permit the ingress of liquid into the cylinder but prevent its escape through the check valve. The upper end of each of the pumps 9, 9' is provided with a spring pressed check valve 28, 28' respectively which permits the escape of liquid from the cylinder but prevents any feedback of the liquid into the cylinder from the respective delivery conduits 16, 16' leading from the pumps.

Connected to the upper end of the schematically shown shaft 26 and rotatably driven thereby is a horizontal shaft 20 which bears two longitudinally spaced similar cams 14, 14' which are shown angularly spaced 90° with respect to each other. Such cams, which are of symmetrical two-lobed construction, cooperate with respective roller cam followers 13, 13' rotatably mounted on the outer ends of levers 12, 12' which are affixed to rock shafts 11, 11' journalled in fixed bearings (not shown). Shafts 11, 11' are affixed to the inner rotatable valve elements of respective valves 10, 10' which are interposed between the respective delivery conduits 16, 16' and conduits 17, 17' leading to the jet nozzles 15, 15', respectively.

In the drawing, lever 3 is in the position after being released by the main surface of cam 7, shaft 1, pressure lever 5 and weft insertion lever 2' moving in the direction indicated by arrows. The weft insertion lever 2 remains pressed down in its lower position, since piston 8 cannot deliver the sucked-in liquid through the closed valve 10. Thus pipe 17 leading to nozzle 15 remains closed. The weft insertion lever 2' follows, by the force of spring 18' bearing against the stationary lower supporting surface 19', pressure lever 5 in the direction indicated by the arrow. Piston 8' moves upwardly in the pump body 9', and this is made possible by the opened valve 10' due to the angular position of shaft 11'. The pressure liquid passes from pipe 16' into pipe 17' and therefrom into nozzle 15' for inserting weft yarn. It will be apparent that the piston 8 of the pump 9, which is inoperative according to the program, remains in its rest or dwell position, after performing the sucking-in stroke, because the closed valve 10 does not allow the escape of liquid from above the piston in pump 9.

The opening of distributor 10' by turning shaft 11' is performed by cam 14' on camshaft 20, as above-described. Cam 14' deflcts lever 12' via roller 13', said lever being fixed to shaft 11'. Camshaft 20 is mounted in a cam housing (not shown) and is driven from a monoblock, said camshaft having, e.g., half the number of revolutions of the weaving machine. Levers 12' and 12, however, may be controlled by an arbitrary mechanism operating in accordance with a preselected program in dependence from the selection of the weft yarn to be inserted.

Pressure lever 5 may be replaced by another pressure means, e.g., a continuous, reciprocatingly moving rule, pressing down periodically the weft inserting levers 2 or 2', and a further weft inserting lever (not shown) at the pumps selected within the appurtenant group for operation.

Although the invention is illustrated and described with reference to a plurality of preferred embodiments thereof, it is to be expressly understood that it is in no way limited by the recitation of such a plurality of embodiments, but is capable of numerous modifications within the scope of the appended claims.

What is claimed is:

1. Method of controlling a plurality of piston pumps in looms with hydraulic nozzles for weft insertion, the pumps being connected to respective nozzles by separate delivering conduits, comprising leaving the pistons of all pumps, after a suction stroke thereof which sucks liquid thereinto, at a rest dwell by the action of counter-pressure of the sucked-in liquid, thereafter opening the delivering conduit of a chosen pump and thrusting the piston thereof in a liquid-delivering stroke, closing the delivering conduit of the chosen pump, and forcing the chosen piston into its next suction stroke.

2. Apparatus for controlling a group of piston pumps in looms with a plurality of hydraulic nozzles for weft insertion comprising individual jet nozzle means supplied by the respective individual pumps, separate delivery conduits connecting the pumps to the respective nozzles, means synchronized with the operation of the loom for simultaneously retracting the pistons of all of the pumps so as to suck liquid into the pumps, individual resilient means overcome by the piston retracting means for constantly urging the pistons in their liquid discharging stroke, valve means interposed in the conduit means connecting the pumps to the individual nozzle means whereby alternately to open and close such conduit means, and means driven in synchronism with the operation of the loom for opening and closing the respective valves.

3. Apparatus according to claim 2, wherein the pumps are disposed in spaced parallel relationship, and wherein the means for retracting the pistons comprises a rock shaft, a lever connected to the rock shaft acting upon the piston rods positively to retract them in timed relationship with the operation of the loom.

4. Apparatus according to claim 3, wherein the means for thrusting the pistons in their liquid delivering stroke comprise individual coil compression springs telescoped about the piston rods of the respective pumps.

5. Apparatus according to claim 3, wherein the means for oscillating the rock shaft comprises a cam having a cam surface of varying radial dimension followed by a can follower receiving seat which the cam follower occupies at the rest dwell, and a cam follower lever affixed to the rock shaft and cooperating with the cam.

6. Apparatus according to claim 2, wherein the means for alternately opening and closing said valves comprises a rotary driven shaft carrying a plurality of individual cams for controlling the respective valves, and drive means synchronizing the rotation of the shaft bearing the valve controlling cams with the cam which controls the rock shaft for retracting the pistons of the pumps.

* * * * *